US005394652A

United States Patent [19]

Casillas et al.

[11] Patent Number: 5,394,652

[45] Date of Patent: Mar. 7, 1995

[54] SANDING WHEEL FOR RAISED WOODEN PANELS

[75] Inventors: Abel R. Casillas, Los Angeles; Jose R. Gutierrez, Long Beach; Frederick C. Schneider, III, Palos Verdes Estates, all of Calif.

[73] Assignee: The Visser Irrevocable Trust 1992-1, Englewood, Colo.

[21] Appl. No.: 157,886

[22] Filed: Nov. 23, 1993

[51] Int. Cl.[6] ..... B24B 9/18

[52] U.S. Cl. ..... 451/241; 451/549

[58] Field of Search ..... 51/128, 283 E, 281 R, 51/208, 210

[56] References Cited

U.S. PATENT DOCUMENTS

| | | | |
|---|---|---|---|
| 1,795,702 | 3/1931 | Barton | 51/366 |
| 2,120,624 | 6/1938 | Pearson | 51/364 |
| 2,257,061 | 9/1941 | Morris | 51/364 |
| 2,265,581 | 12/1941 | Stahl | 51/364 |
| 2,432,753 | 12/1947 | McGriffin | 51/208 |
| 2,494,818 | 1/1950 | Kristek | 51/364 |
| 2,720,064 | 10/1955 | Klug | 51/365 |
| 2,741,073 | 4/1956 | Schwabe | 51/128 |
| 2,778,167 | 1/1957 | Klumpp | 51/364 |
| 2,993,312 | 7/1961 | Holland et al. | 51/210 |
| 3,517,462 | 6/1970 | Imhof | 51/128 |
| 4,053,288 | 10/1977 | Barron, Sr. | 51/128 |
| 4,322,915 | 4/1982 | Kindig | 51/128 |
| 4,437,269 | 3/1984 | Shaw | 51/407 |
| 4,606,154 | 8/1986 | Hermann | 51/401 |
| 4,744,180 | 5/1988 | Voorhees | 51/358 |
| 4,870,787 | 10/1989 | Voorhees | 51/358 |

FOREIGN PATENT DOCUMENTS

| | | | |
|---|---|---|---|
| 450529 | 9/1927 | Germany | 51/366 |
| 356890 | 8/1992 | Germany | 51/364 |

OTHER PUBLICATIONS

Brochure of Larick Machinery, Inc. (c.1990).
Brochure of Arminius (c.1990).
Brochure of Fast Technological Development (c.1990).
Brochure of Fletcher Machine, Inc. (c.1990).
Brochure of Voorwood (c.1990).
Brochure of Nicolas Industries (c.1990).
Brochure of Reckmann (c.1990).
Brochure of Shimura Iron Works Co., Ltd. (c.1990).
3 Sheets of Drawings of an Earlier Sanding Wheel of Assignee c. 1992.

*Primary Examiner*—Robert A. Rose
*Attorney, Agent, or Firm*—W. Scott Carson

[57] ABSTRACT

A sanding wheel modified to incorporate a rub collar that provides a guide surface for sanding raised wooden panels. The modified sanding wheel was specifically designed and is particularly useful for accurately and quickly sanding arched panels. The wheel includes a base support member, sanding members, and a specially adapted rub collar. The rub collar has two portions with the first or inner portion being rotated as a unit with the base support and sanding members and the second or outer portion being mounted for movement independent thereof. The second or outer portion has a guide surface and in operation, the arched portion of the raised wooden panel is abutted against the guide surface and moved therealong with the raised, arched surface to be sanded abutting the rotating sanding surfaces of the sanding members.

13 Claims, 6 Drawing Sheets

Fig. 4
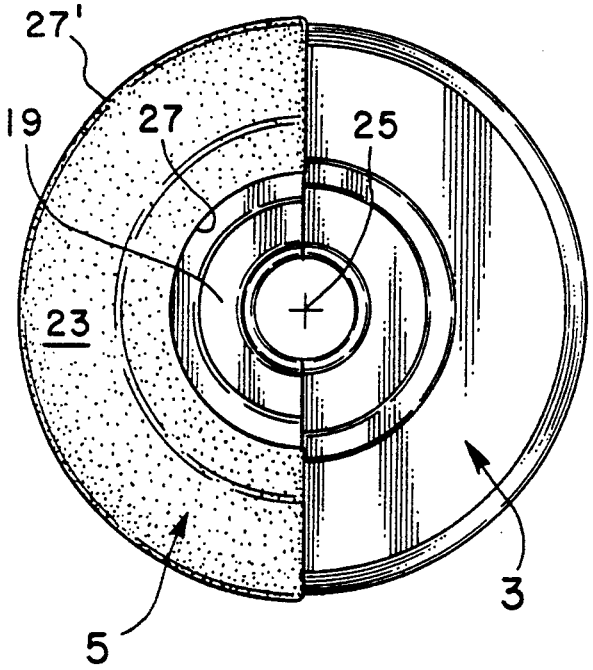
Fig. 5
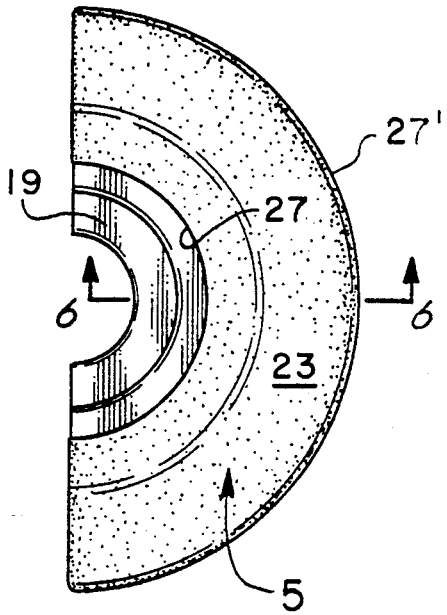
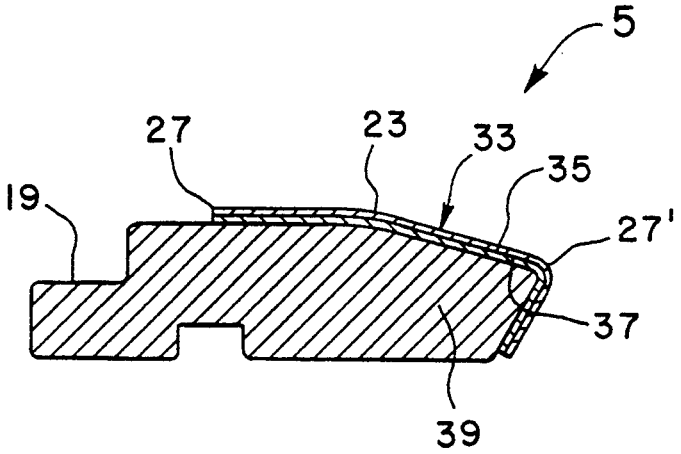
Fig. 6

SANDING WHEEL FOR RAISED WOODEN PANELS

BACKGROUND OF THE INVENTION

1. Field of the Invention

This invention relates to the field of sanding apparatus and more particularly, to the field of sanding wheels for raised panels which have arched peripheral portions.

2. Discussion of the Background

Raised wooden panels with arched or curved perimeter portions present unique problems for sanding. Such panels are widely used in cabinets and particularly in kitchen cabinets and are becoming increasingly more popular. Unlike a raised panel with a simple square or rectangular periphery or perimeter, arched panels as the name implies typically have a crown or arch shape in one or more of the panel sides. Commonly, the arch is in the top side of the panel with the other sides simply being straight or linear.

The straight sides of such a raised panel can easily be sanded by simply pressing the side against a linear guide and passing it by a rotating sanding wheel. The arched side, however, cannot be so easily guided and more often than not, the raised surface on the arched side is sanded without any guides. The accuracy of such sanding is then dependent almost entirely on the manual skill and precision of the operator. In high volume, mass production operations, cost and conformity of the sanded panels are critical and in them, the sanding of the arched portion of the raised panel has always presented speed and accuracy problems.

With this in mind, the present invention was developed. With it, a simple sanding wheel has been modified to include a guide surface wherein the arched portion of a raised wooden panel can be accurately and quickly sanded in a controlled and cost effective manner.

SUMMARY OF THE INVENTION

This invention involves a sanding wheel which has been modified to incorporate a rub collar that provides a guide surface for sanding raised wooden panels. The modified sanding wheel was specifically designed and is particularly useful for accurately and quickly sanding arched panels. The wheel includes a base support member, sanding members, and a specially adapted rub collar. The base support is preferably a rotatably driven disc-shaped member to which two, C-shaped sanding members and a rub collar have been removably secured. The rub collar has two portions with the first or inner portion being rotated as a unit with the base support and sanding members and the second or outer portion of the rub collar being mounted for movement independent thereof. The second or outer portion has a guide surface and in operation, the arched portion of the raised wooden panel is abutted against the guide surface and moved therealong with the panel's raised, arched surface to be sanded abutting the rotating sanding surfaces of the sanding members.

BRIEF DESCRIPTION OF THE DRAWINGS

FIG. 4 is a top plan view of the disc-shaped support member of the sanding wheel with one of the C-shaped sanding members positioned on it.

FIG. 5 is a top plan view of the other C-shaped sanding member by itself.

FIG. 6 is an enlarged, cross-sectional view taken along line 6—6 of FIG. 5.

DETAILED DESCRIPTION OF THE PREFERRED EMBODIMENTS

Figure 1:
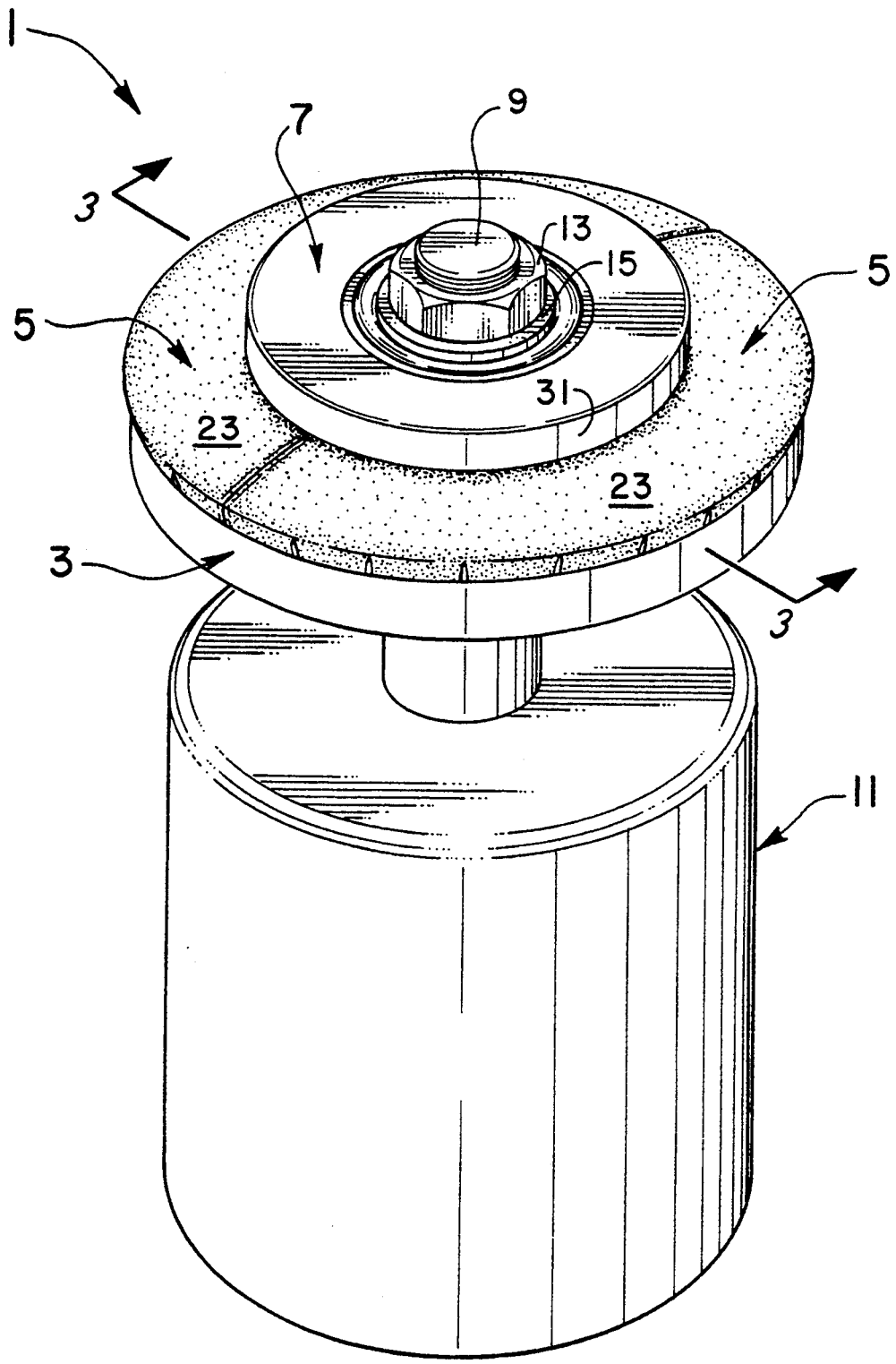
FIG. 1 is a perspective view of the modified sanding wheel of the present invention.
Figure 2:
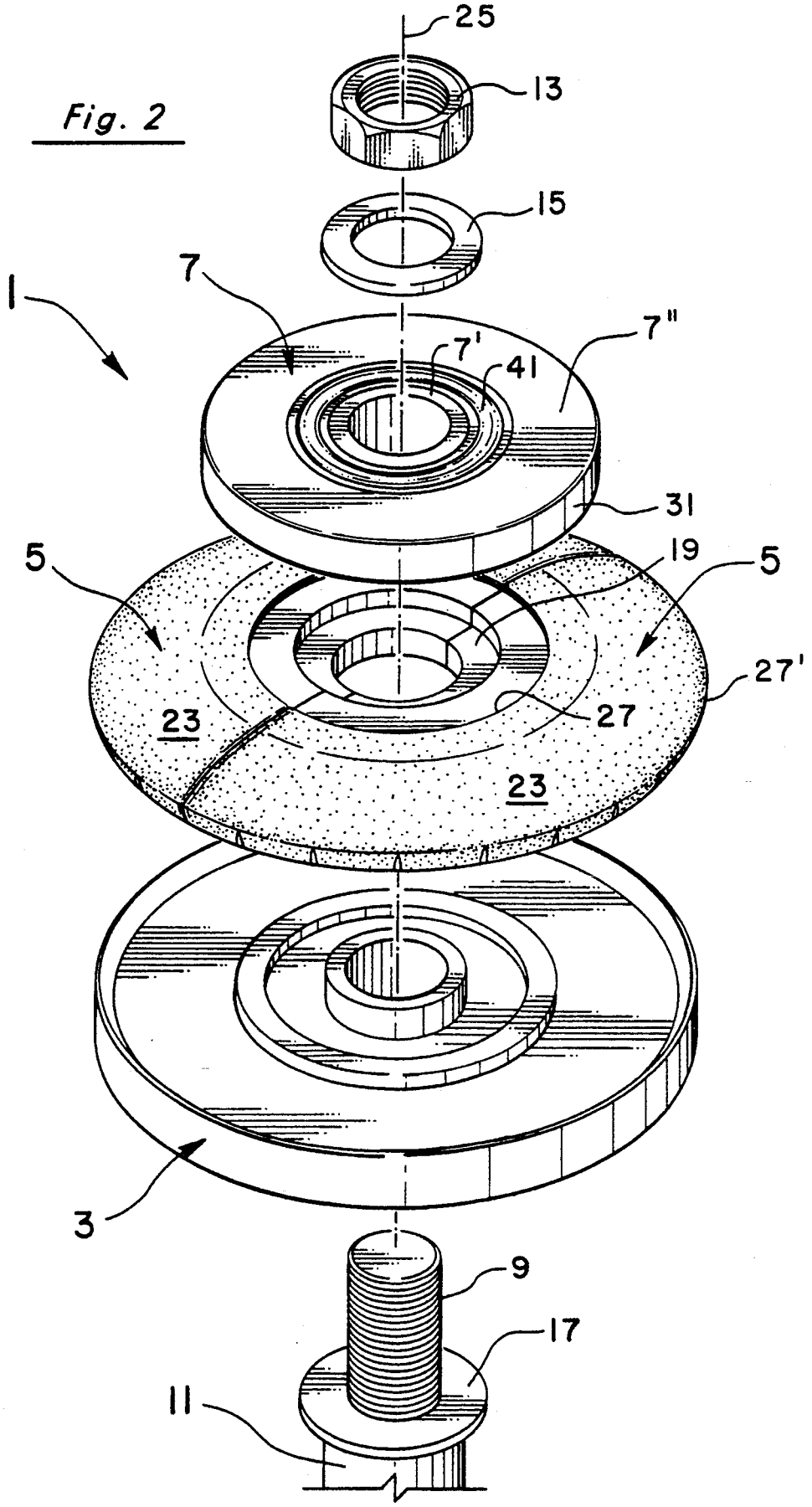
FIG. 2 is an exploded view of the modified sanding wheel.
Figure 3:
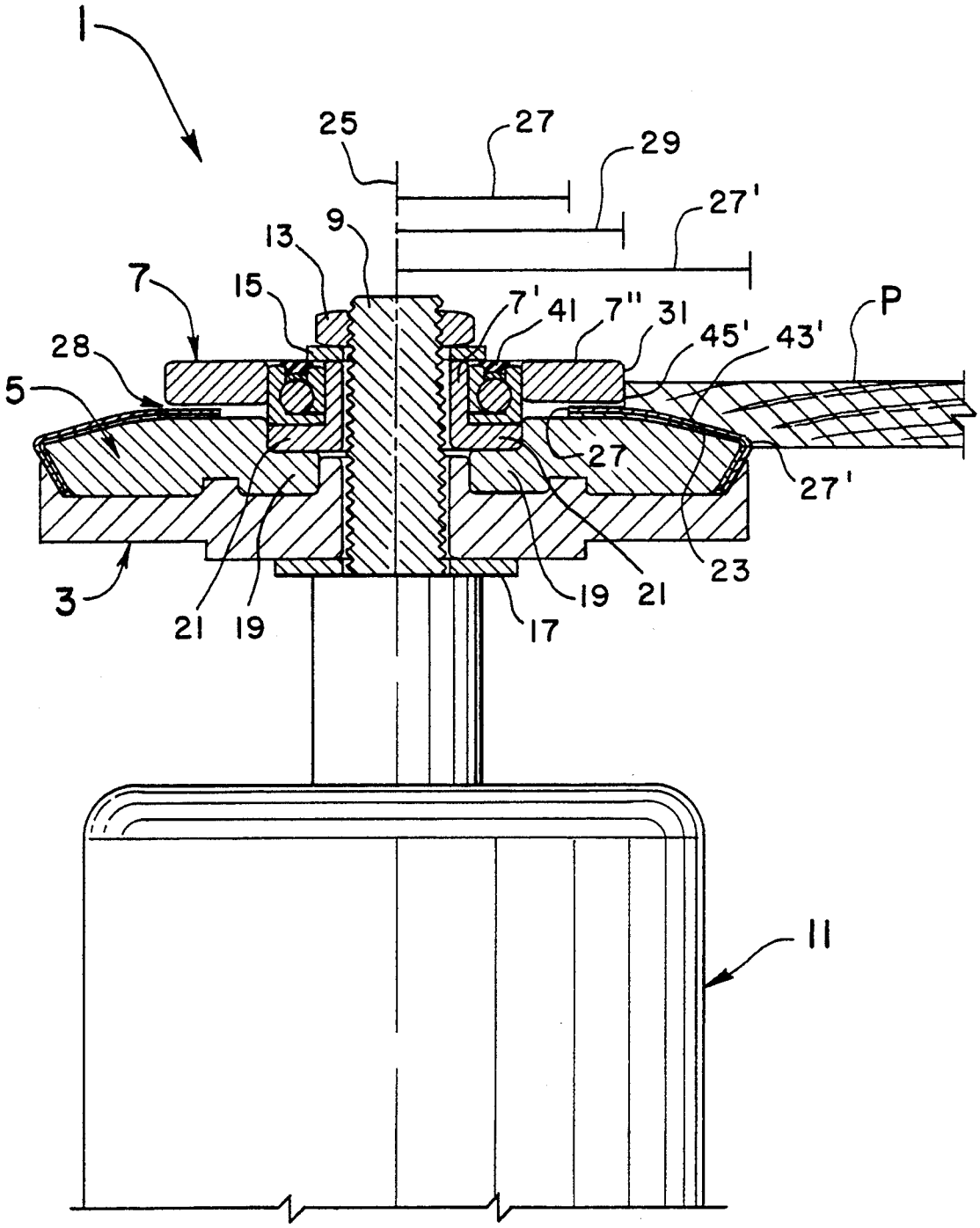
FIG. 3 is a cross-sectional view taken along line 3—3 of FIG. 1 and along line 3—3 of FIG. 9.

As best seen in FIGS. 1–3, the modified sanding wheel 1 of the present invention includes a base support member 3 (see particularly FIG. 2), sanding members 5, and rub collar 7. The base support means or member 3 is preferably disc-shaped and is dimensioned to hold the two, C-shaped sanding members 5 (see FIGS. 3–5) with the rub collar 7 then positioned atop the sanding members 5 as shown in FIG. 1. The assembled relationship of these sanding wheel components 3, 5, and 7 is perhaps best seen in the cross-sectional view of FIG. 3.

In the preferred embodiment of FIG. 3, the rub collar 7 and the sanding members 5 are removably secured to the base support member 3. This is quickly and easily accomplished as shown by simply positioning the threaded shaft 9 of the drive means 11 through the respective holes in the centers of the sanding wheel components 3, 5, and 7 and tightening threaded nut 13. This draws the members 3, 5, and 7 together and tightly secures them to the threaded shaft 9 between the upper nut-washer arrangement 13, 15 and the backing washer 17. In tightening the nut 13, the inner segment 19 of each sanding member 5 is sandwiched between the inner segment 21 of the rub collar 7 and the base support member 3. The sanding members 5 are then tightly clamped in place. Also, with this arrangement, the sanding wheel components 3, 5, and 7 not only can be easily and quickly assembled but also disassembled by simply manipulating the single nut 13. In high volume, mass production, this ease of assembly and disassembly is critical to an efficient and cost effective operation.

The sanding members 5 are preferably two C-shaped pieces as shown in FIGS. 4 and 5 but could be three or more pieces or even just a single, unitary piece. Regardless of whether the annular sanding means 5 is a unitary piece or made up of a plurality of separable pieces, the abrasive sanding surface 23 is preferably substantially continuous and annular about the axis 25 extending between inner and outer radii 27 and 27'. The inner radius 27 of the annular shape of the sanding surface 23 (see FIG. 3) is preferably less than the radius 29 of the cylindrical guide surface 31 of the rub collar 7. In this regard and for reasons discussed in more detail below, the outer portion 7'' of the rub collar means 7 is slightly spaced above the inner part 27 of the sanding surface 23 to form a small gap 28 therebetween. The outer radius 27' of the sanding surface 23 as shown extends outwardly of the axis 25 for a distance greater than the radius 29 of the cylinder guide surface 31. Guide surface 31 then extends about and along the axis 25 at a distance less than the outer radius 27′ of the sanding surface 23 and greater than its inner radius 27.

The sanding surface 23 is preferably on a replaceable strip 33 of sandpaper (see FIG. 6). The strip 33 is then removably secured by the hook-loop fastening arrangement of pieces 35, 37 to the profiled, non-planar, backing portion 39. In this manner, the sanding strip 33 can be easily and quickly removed and replaced as desired.

Figure 7:
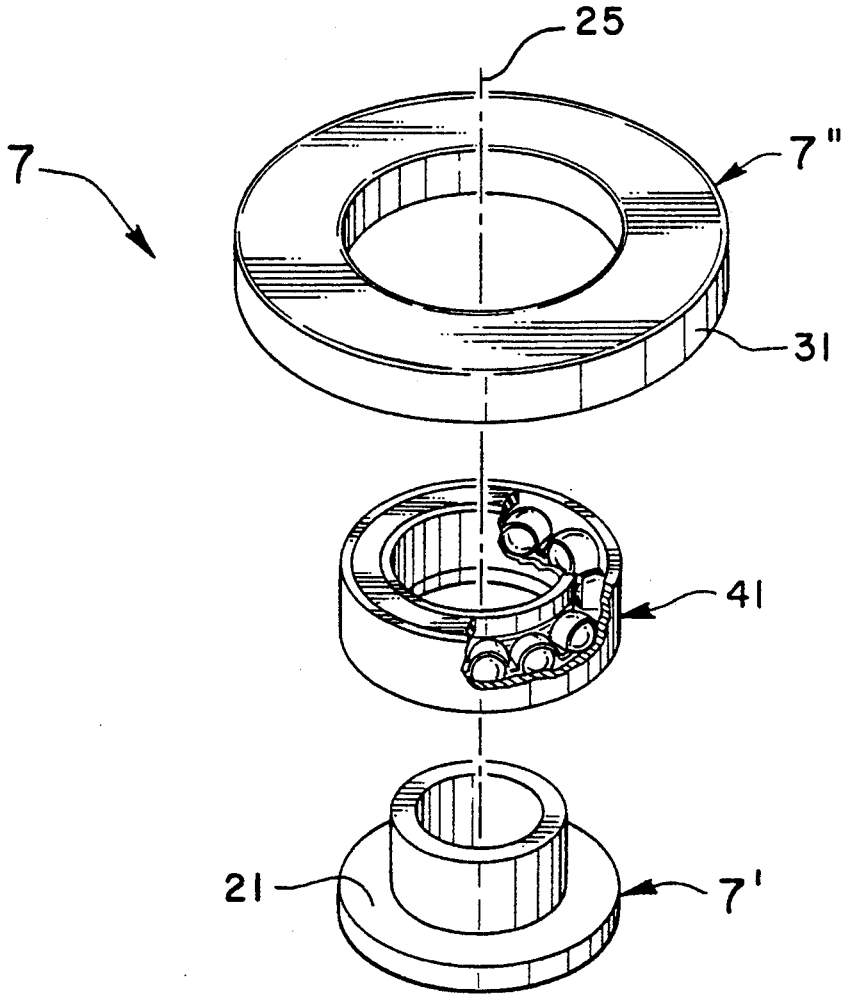
FIG. 7 is an exploded view of the rub collar.

The rub collar 7 is comprised of first and second portions 7′ and 7″ as best seen in FIG. 7. The first or inner portion 7′ receives the drive shaft 9 (see FIG. 3) and is tightened by the nut-washer arrangement 13, 15 to be rotated as a unit about the axis 25 with the base support member 3 and sanding members 5. The second or outer portion 7″ of the rub collar 7 is then mounted about the bearing race 41. The second portion 7″ as discussed above and shown in FIG. 3 is slightly spaced above the inner area at 27 of the sanding surface 23 to form a small gap 28 therebetween. Consequently, when the periphery or perimeter 45′ of the wooden panel E is held against the guide surface 31 of the outer portion 7″ of the rub collar 7, the second or outer portion 7″ may remain stationary and not rotate with the first or inner portion 7′. In operation as discussed in more detail below, this small gap 28 then substantially prevents or eliminates any rubbing between the outer, stationary portion 7″ and the rotating sanding surface 23.

Figure 8:
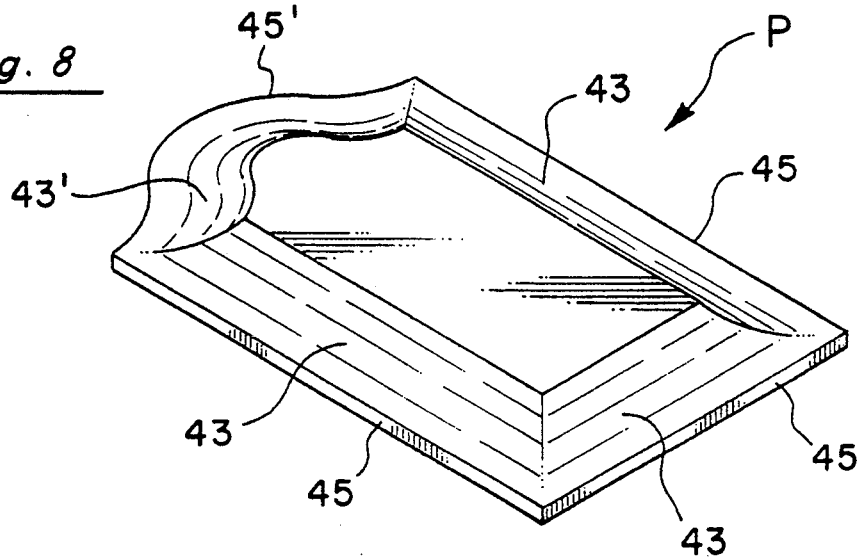
FIG. 8 is a perspective view of a raised wooden panel with an arched peripheral portion for which the modified sanding wheel of the present invention was specifically developed.
Figure 9:
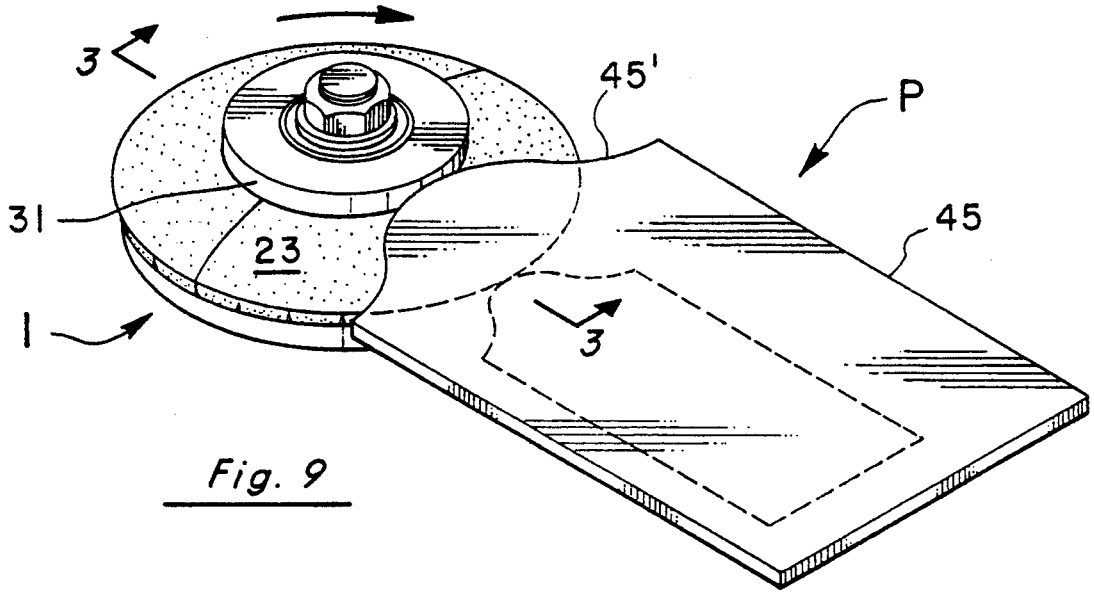
FIGS. 9 and 10 illustrate the modified sanding wheel of the present invention in use to sand the arched portion of the raised wooden panel of FIG. 8.
Figure 10:
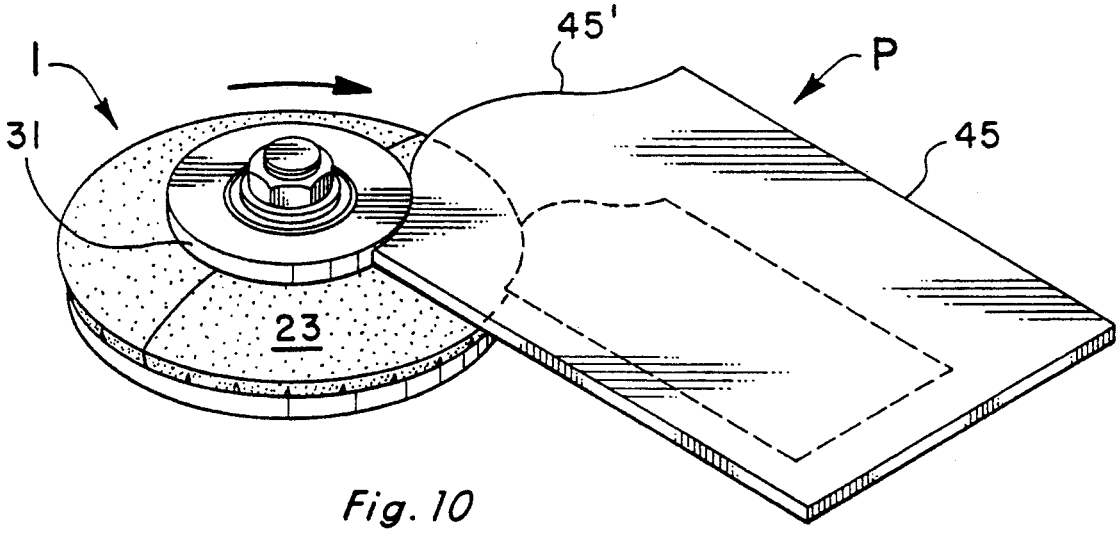

More specifically, the wooden panel E to be sanded as shown in FIG. 8 has been rough cut with raised surfaces at 43 and 43′. Whereas, the straight or linear sides 45 of the panel P can be easily sanded in any number of known manners (e.g., by using a stationary, linear guide on either side of a sanding wheel), the arched or curved side 45′ at the top of the panel P cannot. However, with the modified sanding wheel 1 of the present invention, the raised surface 43′ which extends inwardly of and along this arched or curved perimeter portion 45′ of the panel P can now be accurately and quickly sanded in a controlled and guided manner as shown in FIGS. 9 and 10. In doing so, the raised wooden panel P of FIG. 8 is inverted and then simply passed manually or mechanically over the rotating sanding members 5 with the arched perimeter portion 45′ abutting the guide surface 31 of the rub collar 7 (see also FIG. 3) and with the arched, raised surface 43′ of the panel P abutting the abrasive sanding surface 23. The result is a quick and accurate sanding of the raised surface 43′ of the arched portion 45′. The straight sides 45 of the panel P can equally be sanded on the modified sanding wheel 1 of the present invention but the true advantage of the modified sanding wheel 1 is in its ability to accurately sand the arched portion 45′ of the panel P in a controlled manner.

While several embodiments of the invention have been shown and described in detail, it is to be understood that various modifications and changes could be made to them without departing from the spirit of the invention. For example, the invention has been shown and described with the sanding members 5 having sanding surfaces 23 formed on removable sanding strips 33; however, the sanding surfaces could be integrally formed on the backing portions 39 if desired. Sanding members 5 are also shown and described as being two, substantially identical C-shaped or arcuate members extending respectively 180 degrees about the axis 25; but, the annular ring or other arrangement formed by them could be divided into any number of a plurality of identical or non-identical sanding members or parts which were attached individually or collectively to the support member 3. The sanding members 5 are also preferably distinct members from the base support member 3 but could be integral therewith if desired.

We claim:

1. A sanding wheel with a rub collar means primarily intended for sanding an arch of a raised wooden panel, said sanding wheel including:

base support means, drive means for rotating said base support means about an axis, and means for removably securing said base support means to said drive means, sanding means and means for securing said sanding means to said base support means for rotation therewith about said axis, said sanding means having an abrasive sanding surface extending substantially about said axis and outwardly of said axis for at least a first distance, said sanding means further including a plurality of separable sanding members, each sanding member forming a part of said abrasive sanding surface wherein said parts together form a substantially continuous sanding surface of said axis, and said rub collar means having first and second portions means for removably securing said first portion to said base support means for rotation therewith and means for mounting said second portion to said first portion for rotation about said axis relative to said first portion, said sanding means, and said base support means; said second portion of said rub collar means having a guide surface extending substantially about and along said axis and spaced outwardly of said axis for a distance less than said first distance said sanding surface extends outwardly of said first axis, said wooden panel having a perimeter with at least one arched portion and a raised surface extending inwardly of and along said arched perimeter portion wherein said raised surface can be sanded by abutting the arched perimeter portion of the wooden panel against said guide surface and moving said arched perimeter portion along said guide surface with said raised surface to be sanded abutting the rotating, abrasive sanding surface of said sanding means.

2. The sanding wheel of claim 1 wherein said guide surface of said second portion of said rub collar means is substantially cylindrical about and along said axis.

3. The sanding wheel of claim 2 wherein said abrasive sanding surface is substantially annular about said axis and extends between inner and outer radii, said cylindrical guide surface extending about said axis at a radius with said inner radius of said annular sanding surface being less than the radius of said cylindrical guide surface wherein said cylindrical guide surface is positioned outwardly of the inner radius of said sanding surface relative to said axis.

4. The sanding wheel of claim 3 wherein said abrasive sanding surface is part of at least one sanding strip and said sanding means includes said sanding strip, at least one backing portion, and means for removably attaching said sanding strip to said backing portion.

5. The sanding wheel of claim 4 wherein said means for removably securing said sanding strip to said backing portion includes hook-loop fastening means.

6. The sanding wheel of claim 3 further including means for positioning said second portion of said rub collar means spaced from said abrasive sanding surface to produce a slight gap therebetween to substantially eliminate any rubbing between said second portion and said abrasive sanding surface.

7. The sanding wheel of claim 1 wherein said abrasive sanding surface extends closer to said axis than the guide surface of said second portion of said rub collar means and said sanding wheel further including means for positioning said second portion of said rub collar means spaced from said abrasive sanding surface to produce a slight gap therebetween to substantially eliminate any rubbing between said second portion and said abrasive sanding surface.

8. The sanding wheel of claim 1 wherein said sanding means is removably secured to said base support means and has a segment sandwiched between a segment of said first portion of said rub collar means and said base support means, and said respective means for securing said sanding means and said rub collar means to said base support means include means for drawing said segment of said first portion toward said base support means to clamp said sandwiched segment of said sanding means therebetween wherein said drive means rotates said base support means, sanding means, and first portion of said rub collar means about said axis as a unit.

9. The sanding wheel of claim 1 wherein said base support means includes a substantially disc-shaped member with a hole through the center thereof, said sanding means and said rub collar means have respective holes therethrough, and said drive means includes a shaft receivable through the holes in said disc-shaped member, sanding means, and rub collar means, and said drive means further includes means for removably securing said disc-shaped member, said sanding means, and said first portion of said rub collar means to said shaft with said shaft extending through said holes and means for rotating said shaft and said disc-shaped member, sanding means, and first portion of said rub collar means secured thereto about said axis.

10. The sanding wheel of claim 1 wherein said plurality of sanding members include first and second substantially C-shaped members.

11. The sanding wheel of claim 10 wherein each of said first and second C-shaped members extends substantially 180 degrees about said axis.

12. The sanding wheel of claim 1 wherein each of said plurality of sanding members is a portion of a substantially annular ring spaced from and extending about said axis when said sanding means is secured to said base support means to form and define an opening about said axis, said means for removably securing said base support means to said drive means including means dimensioned to fit within said opening.

13. The sanding wheel of claim 1 wherein each of said sanding members includes a backing portion with a profiled, non-planar surface, a sanding strip, and means for removably securing said sanding strip to said backing portion.

* * * * *